US005363785A

United States Patent [19]

Conley, Jr.

[11] Patent Number: 5,363,785

[45] Date of Patent: Nov. 15, 1994

[54] NON-INTRUSIVE WORKPIECE PALLET LOCATOR

[75] Inventor: Ralph F. Conley, Jr., Miamisburg, Ohio

[73] Assignee: MIM Industries, Inc., Miamisburg, Ohio

[21] Appl. No.: 934,715

[22] Filed: Aug. 24, 1992

[51] Int. Cl.[5] ..... D05B 21/00

[52] U.S. Cl. ..... 112/121.15; 112/262.3; 198/346.1; 198/345.3; 198/741; 198/345.1; 414/222; 414/750

[58] Field of Search ..... 198/346.1, 345.3, 741, 198/345.1, 468.2; 414/222, 750; 112/121.15, 121.12, 104, 119, 262.3, 121.29, 311

[56] References Cited

U.S. PATENT DOCUMENTS

| | | | |
|---|---|---|---|
| 2,711,817 | 6/1955 | Hautau et al. | 198/468.2 X |
| 3,075,651 | 1/1963 | Kaden | 198/468.2 X |
| 4,306,646 | 12/1981 | Magni | 198/346.1 X |
| 4,422,393 | 12/1983 | Johnson et al. | 112/121.15 |
| 4,602,578 | 7/1986 | Yokoe et al. | 112/121.15 |
| 4,660,280 | 4/1987 | Asai et al. | 198/345.1 X |
| 4,694,766 | 9/1987 | Wickers et al. | 112/262.1 |
| 4,883,006 | 11/1989 | Marii et al. | 112/121.12 |
| 5,003,897 | 4/1991 | Yokoe et al. | 112/121.12 |
| 5,074,230 | 12/1991 | Marii et al. | 112/121.15 |
| 5,078,253 | 1/1992 | Vermeer et al. | 198/345.1 |

*Primary Examiner*—Clifford D. Crowder
*Assistant Examiner*—Paul C. Lewis
*Attorney, Agent, or Firm*—Biebel & French

[57] ABSTRACT

A workpiece pallet locator is provided which is adapted to engage a workpiece pallet on a support surface in a non-intrusive manner. The pallet locator includes slots formed in the workpiece support surface and pawl members which are movable in a vertical direction to pass through the slots and into engagement with a pallet on the support surface. The pawl members are movable in X and Y directions for moving the pallet to different stations on the support surface. As a result of moving the pawl members upwardly into engagement with the pallet, the coupling point between the locator and the pallet is formed at a location below the support for the workpiece such that the coupling point does not interfere with positioning the workpiece on the pallet and support surface.

29 Claims, 3 Drawing Sheets

NON-INTRUSIVE WORKPIECE PALLET LOCATOR

BACKGROUND OF THE INVENTION

1. Field of the Invention

This invention relates to a pallet locator for a sewing system, and more particularly, it relates to a workpiece pallet locator which is non-intrusive such that interference will not occur between a workpiece and the pallet locator as the workpiece is moved into position in a sewing station.

2. Description of Related Art

In the sewing industry, it is often necessary to position a workpiece on a workpiece pallet and then move the workpiece and pallet into position within a sewing station. During this operation, the workpiece is manually clamped onto the workpiece pallet and a shuttle mechanism may be provided for moving the pallet containing the workpiece along a table and into association with a drive mechanism which engages the pallet. The drive mechanism is then energized by a controller to cause the drive to move the pallet underneath a sewing head in a predetermined pattern to provide a desired stitch on the workpiece.

Currently available shuttle mechanisms for moving the pallet into association with the drive mechanism typically engage the workpiece pallet at a location near the top of the pallet and the shuttle mechanism extends over the table area upon which the pallet is intended to be moved. However, when large workpieces having edges extending beyond the perimeter of the pallet are to be sewn, such shuttle mechanisms have proven to be inconvenient in that the connection point between the shuttle mechanism and the pallet often interferes with the edges of the workpiece extending beyond the pallet. In addition, provision of the shuttle mechanism above the worktable area reduces the available access area to the pallet during the operation of positioning the workpiece thereon.

A further problem associated with systems for locating a workpiece in a sewing area is the necessity for an operator to hold an unclamped portion of the workpiece on the pallet as the pallet is moved into association with the sewing station in order to ensure that the pieces to be sewn do not shift relative to each other prior to reaching the station.

Accordingly, there is a need for a non-intrusive workpiece pallet locator system which permits a workpiece to be easily positioned on the pallet and wherein the mechanism for locating the pallet into a sewing station does not interfere with portions of the workpiece extending beyond the edges of the pallet. In addition, there is a need for a workpiece locator system in which the workpiece may be conveniently positioned within a sewing station while the workpiece is positively held in position on the pallet without the need for an operator maintaining contact with the workpiece.

SUMMARY OF THE INVENTION

In one aspect, the present invention provides a workpiece pallet locator comprising a support surface for supporting a workpiece pallet; and locator means adapted to be operatively coupled to the workpiece pallet for moving the workpiece pallet in a non-intrusive manner.

In a further aspect of the invention, the locator means is adapted to be positioned beneath a workpiece located over a coupling point between the workpiece pallet and the locator means. Further, the locator means may be positioned in a location below a plane defined by an upper surface of the workpiece pallet.

In yet a further aspect of the present invention, the support surface includes means defining a major elongated slot therethrough and a plurality of minor elongated slots extending substantially perpendicular from the major slot. The locator means is positioned beneath the support surface and is movable in an X direction parallel to the support surface and in a Y direction parallel to the support surface and perpendicular to the X direction. The locator means includes pawl means movable in a Z direction perpendicular to the X and Y directions for engaging apertures formed in the workpiece pallet.

A drive means is provided at a sewing station and is adapted to engage the workpiece pallet as the locator means moves the pallet into position in the sewing station. In addition, holder means are provided adapted to move toward and hold the workpiece on the workpiece pallet, and a control means is provided for actuating the locator means, the drive means and the holder means in a predetermined sequence of operations.

Therefore, it is an object of the present invention to provide a workpiece pallet locator for engaging and guiding a workpiece pallet in a non-intrusive manner.

It is a further object of the invention to provide a pallet locator which is adapted to engage a workpiece pallet through slots in a support surface in order to avoid interference with a workpiece supported on the workpiece pallet.

It is yet another object of the invention to provide a workpiece pallet locator including automatically actuated holder means for holding a workpiece in position on a pallet.

Other objects and advantages of the invention will be apparent from the following description, the accompanying drawings, and the appended claims.

DETAILED DESCRIPTION OF THE PREFERRED EMBODIMENT

Figure 1:
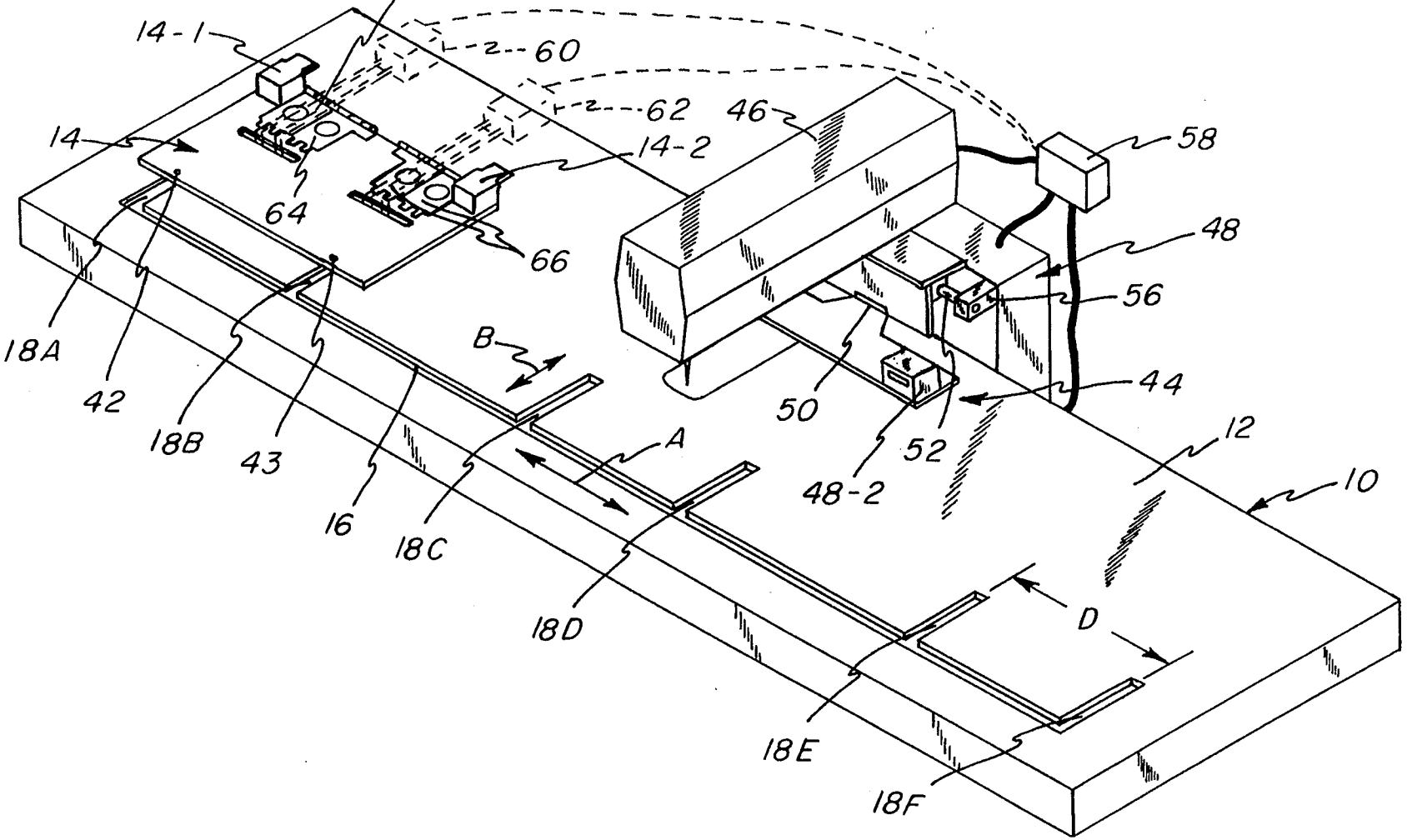
FIG. 1 is a perspective view of the workpiece pallet locator of the present invention including its use in association with a sewing system.

Referring to FIG. 1, the workpiece pallet locator of the present invention includes a table portion 10 having a substantially planar upper support surface 12 for supporting a workpiece pallet 14 thereon. The support surface 12 includes means defining an elongated major aperture or slot 16 extending therethrough and oriented in an X direction, indicated by double arrow A. In addition, a plurality of minor slots 18A–F extend perpendicularly from the major slot 16 in a Y direction, indicated by double arrow B. The plurality of minor slots 18A–F define three distinct stations along the major slot 16 wherein minor slots 18A and 18B define a first station, minor slots 18C and 18D define a second station and minor slots 18E and 18F define a third station. The pairs of minor slots 18A–F defining the first, second and third stations are spaced apart a predetermined distance D at each of the stations.

Figure 2:
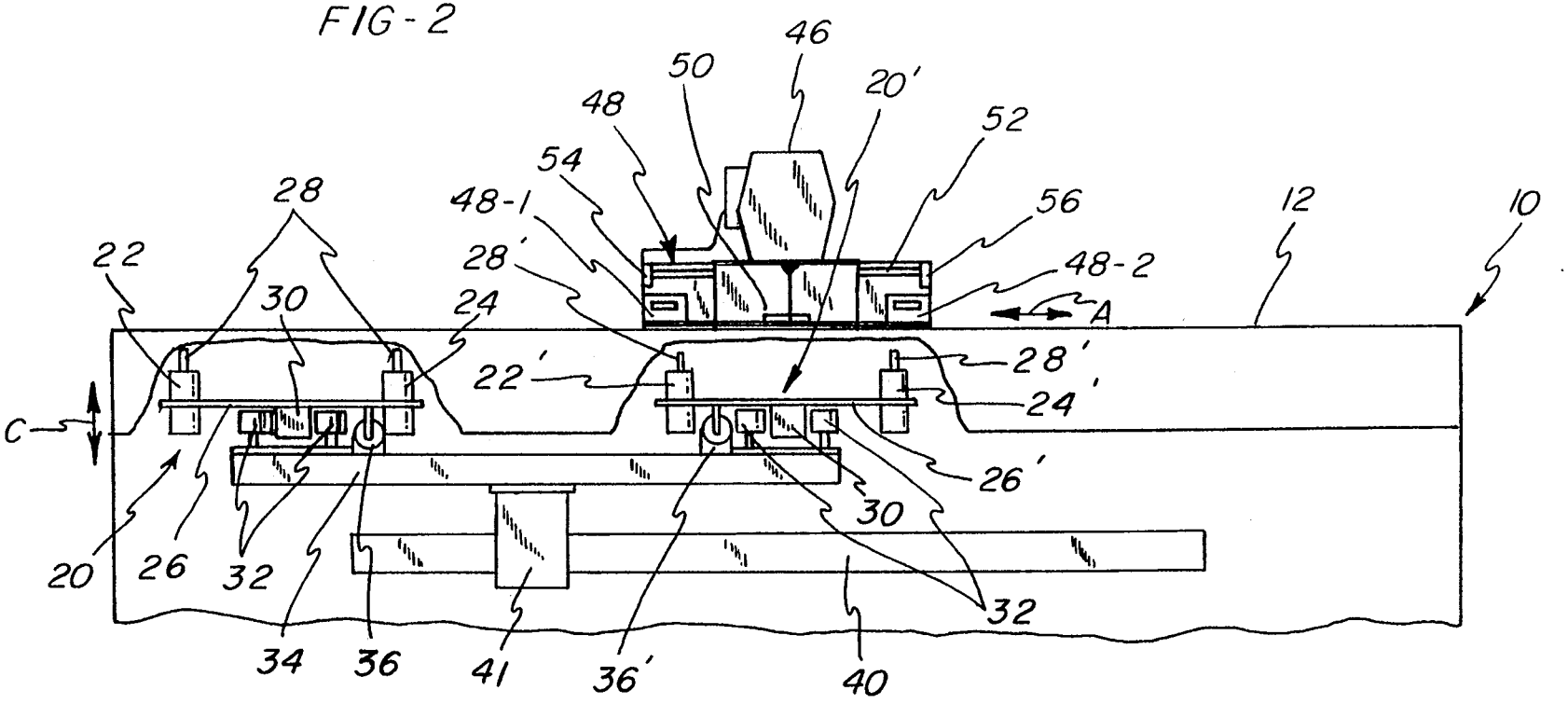
FIG. 2 is a partially cut-away front elevational view of FIG. 1 showing the portion of the pallet locator located underneath the support surface.
Figure 3:
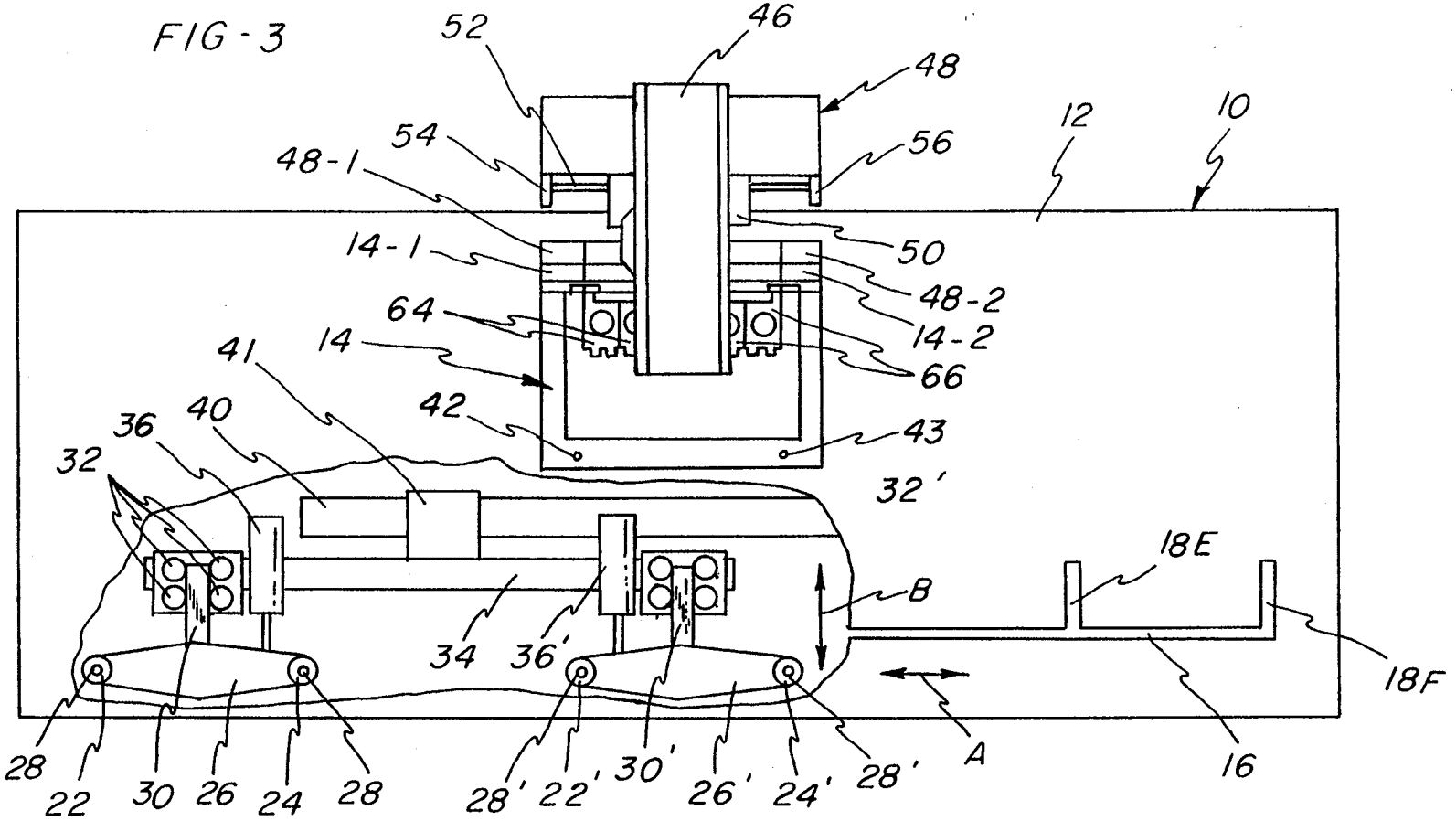
FIG. 3 is a partially cut-away plan view of FIG. 1 showing the portion of the pallet locator located underneath the support surface.

Referring to FIGS. 2 and 3 the workpiece pallet locator further includes a first pallet engaging portion 20 and a second pallet engaging portion 20'. The second pallet engaging portion 20' is substantially similar in structure to the first pallet engaging portion 20 and the structure of the pallet engaging portions 20 and 20' will be hereinafter described with reference to the first pallet engaging portion 20 wherein similar elements in the second pallet engaging portion 20' are indicated in the drawings with the same numeral prime.

The pallet engaging portion 20 includes a first actuation cylinder 22 and a second actuation cylinder 24 mounted in spaced relationship to each other on a spacer arm 26. The cylinders 22, 24 are preferably pneumatically actuated and include identical pawl members or pins 28 which are movable in a vertical Z direction, indicated by double arrow C, perpendicular to the X and Y directions. The spacer arm 26 is rigidly mounted to a guide bar 30 which is guided in movement in the Y direction by bearings 32 mounted on a support bar 34. The guide bar 30 and spacer arm 26 are actuated for movement in the Y direction by a pneumatic cylinder 36 rigidly mounted to the support bar 34 and having an actuation rod 38 attached to the spacer arm 26.

The support bar 34 is supported on a stationary rail 40 by means of a sleeve 41 extending around the rail 40 and rigidly attached to the support bar 34. The sleeve 41 is movable along the rail 40 in the X direction and may be actuated for movement in any conventional manner such as by forming the rail 40 as a rodless pneumatic cylinder incorporating the sleeve 41 as the actuated element, or by providing other conventional actuators such as those incorporating motors.

It should be noted that the actuation cylinders 22 and 24 are spaced apart the distance D equal to the spacing between the pairs of minor slots 18A–F at each station. In addition, the first engaging portion 20 is spaced from the second engaging portion 20' a distance equal to the spacing between adjacent stations defined by the pairs of minor slots 18A–F such that the pins 28 for the first engaging portion 20 may be aligned with one of the stations defined on the support surface 12 while the pins 28' for the second engaging station 20' are aligned with the slots for an adjacent one of the stations defined in the support surface 12. For example, the pins 28 may be aligned with minor slots 18A and 18B while the pins 28' will be aligned with the minor slots 18C and 18D. The pins 28 and 28' are adapted to extend through the minor slots 18A–F to engage within apertures 42 and 43 defined in the workpiece pallet 14 to thereby form a coupling between the workpiece pallet 14 and the locator means. With the workpiece pallet 14 thus engaged, the locator means may move the pallet 14 along a path in the Y direction defined by the minor slots 18A–F as well as in the X direction along the major slot 16. Thus, the workpiece pallet 14 may be loaded or unloaded at the first or third station defined by the respective minor slots 18A, 18B and 18E, 18F, and the pallet 14 may be moved to the central second station defined by the slots 18C and 18D to align the pallet with a sewing station 44.

The sewing station 44 is of conventional construction and includes a sewing head 46 for sewing a workpiece located on the pallet 14, and drive means 48. The drive means 48 includes a first receiving member 48-1 and a second receiving member 48-2 located on a pallet drive plate 50. The drive means 48 may be of conventional construction including a shaft 52 coupled to the pallet drive plate 50 for permitting the workpiece pallet 14 to move in the X direction. The shaft 52 is coupled to a pair of support posts 54 and 56 (see FIG. 3) which can cause the shaft 52 and pallet drive plate 50 to move in the Y direction.

The posts 54, 56 are coupled to a first stepper motor (not shown) by various belts, gears and pulleys (not shown) whereby the pallet drive plate 50 is driven in the X direction. In addition, a second stepper motor (not shown) may be coupled by various belts, gears and pulleys (not shown) to the pallet drive plate 50 whereby the pallet drive plate 50 may be energized to move in the Y direction.

The first and second stepper motors are selectively energized by a controller 58 to move the workpiece pallet 14 in the X and Y directions in accordance with a program. Further, the controller 58 may be used to control operation of the sewing head 46 as well as actuation of the pallet locator to move the pins 28, 28' to desired locations for positioning the pallet 14 at predetermined positions on the support surface 12. In particular, the controller 58 is programmed to move the pallet 14 from either the first or third station at either end of the major slot 16 to the second station defined by minor slots 18C and 18D where the pallet 14 may be transferred from engagement with the pins 28, 28' to engagement with the pallet drive plate 50 as pallet connectors 14-1 and 14-2 are moved into engagement with the receiving members 48-1 and 48-2.

Referring to FIG. 1, the pallet 14 may also be provided with holding means for automatically engaging and holding a workpiece on the pallet 14 in order to assist the user in loading a workpiece in the pallet 14. The holding means are depicted diagrammatically as 60 and 62 and are supported on the support surface 12. Although the holding means is shown in FIG. 1 as being located on one end of support surface 12, it could also be located on the other end or on both ends of support surface 12 if desired. This would facilitate enabling a user to load one or more pallets 14 at either end of support surface 12. The holding means 60 and 62 may be in the form of pneumatic cylinders which actuate one or more pin members or fingers to move downwardly from the cylinder into engagement with the workpiece on the pallet surface. In addition, the holding means 60 and 62 are coupled to the controller 58 such that the holding means 60 and 62 can be automatically energized to engage and disengage from a workpiece on the pallet 14.

During operation of the present invention, a pallet may be located in the position shown by the pallet 14 in FIG. 1 where the holders 64 and 66 clamp a first portion of the workpiece to be sewn in position on the pallet 14 and the holding means 60 and 62 are subsequently actuated to hold a second portion of the workpiece to be sewn such that relative movement between the first and second portions of the workpiece is prevented. The cylinders 22 and 24 are energized by the controller 58 such that the pins 28 move vertically to extend upwardly through the support surface 12 and into engagement with the apertures 42 and 43 of the pallet 14. With the locator thus coupled to the pallet 14, the cylinder 36 is energized to move the pins 28 toward the major slot 16 and the rodless cylinder 40 is energized to subsequently move the pallet 14 from the first station into alignment with the minor slots 18C and 18D at the second station. At the second station, the cylinder 36 is again energized to move the pallet toward the sewing station 44 to cause the connectors 14-1 and 14-2 to engage the respective receiving members 48-1 and 48-2 whereupon the cylinders 22 and 24 are energized to retract the pins 28 out of engagement with the pallet 14. At this time, the controller 58 will energize the drive means 48 to move the pallet 14 in a predetermined path underneath the sewing head 46 to produce a predetermined stitch pattern on the workpiece.

During the sewing operation, a second pallet (not shown) containing a workpiece to be sewn may be located at the third station defined by minor slots 18E and 18F and engaged by the pins 28' in preparation for movement to the second station in a manner similar to that described above with regard to the pallet 14. Thus, upon completion of the sewing operation, the drive means 48 will move the apertures 42 and 43 of the pallet 14 back into alignment with the ends of the slots 18C and 18D where the pins 28 will again engage with the pallet 14 to move the workpiece back to the first station while the second pallet (not shown) will be moved simultaneously from the first station to the second station in preparation for the sewing operation.

It should be understood that the locator of the present invention may be used in a sequence of operations different from that described above. For example, instead of loading a second pallet at the third station, the first engaging portion 20 may be moved back to the first station to load a second pallet (not shown) at the first station as the sewing operation on the first pallet 14 is being performed, and the second engaging portion 20' may be used to engage the first pallet 14 after the sewing operation and thereafter move it to the third station for removal from the support surface as the first engaging portion 20 moves the second pallet to the second station. The particular use of the locator of the present invention will depend on the requirements of the workpieces being used and the sewing operations being performed.

It should be apparent that the present invention provides a workpiece pallet locator which is conducive to use with large workpieces which extend beyond the boundaries of the pallet in that the locator engages the pallet at a coupling point which is beneath the pallet surface supporting the workpiece such that the present locator forms a non-intrusive connection which avoids interference with the workpiece. Thus, this aspect of the invention is particularly useful when sufficient clearance room must be provided for permitting the workpiece to lie flat across the support surface. A further advantage of the present design for the locator results from the drive means for the locator being positioned beneath the table surface such that the drive mechanism does not take up work space and access room for the workpieces and pallets located on the support surface. Yet another advantage of the invention results from providing holder means which may be automatically actuated to facilitate accurate positioning of the workpiece on the pallet.

While the form of apparatus herein described constitutes a preferred embodiment of the invention, it should be noted that the invention is not limited to this precise form of apparatus and that changes may be made therein without departing from the scope of the invention which is defined in the appended claims.

What is claimed is:

1. A workpiece pallet locator system comprising:

a support surface for supporting a workpiece pallet; and locator means for operatively coupling to a workpiece pallet on said support surface, including means to move said locator means in at least three orthogonal directions in a predetermined sequence of operations.

2. The pallet locator system as in claim 1 wherein said locator means engages the workpiece pallet at a coupling point and said means to move said locator means is operative to position said locator means beneath a workpiece located over said coupling point.

3. The pallet locator system as in claim 1 wherein the workpiece pallet includes an upper surface defining a plane and said locator means is located below said plane.

4. The pallet locator system as in claim 1 wherein said locator means is moveable through said support surface to engage with the workpiece pallet.

5. The pallet locator system as in claim 1 in combination with drive means for engaging and guiding the workpiece pallet in movement along said support surface.

6. The pallet locator system as in claim 5 wherein said means to move said locator means causes said locator means to move the workpiece pallet into engagement with said drive means.

7. The pallet locator system as in claim 6 including means to move said drive means wherein said means to move said drive means is energized by control means to move the workpiece pallet to predetermined positions within a sewing station.

8. The pallet locator system as in claim 1 in combination with holding means for holding a workpiece on the workpiece pallet and control means for automatically actuating said holding means.

9. A non-intrusive workpiece pallet locator system comprising:

a support surface;

means defining an aperture portion in said support surface;

locator means for engaging and locating a workpiece pallet; and means to move said locator means to extend and retract through said aperture portion in a first direction for engaging with and disengaging from the workpiece pallet wherein said means to move said locator means is operative to move said locator means in a second direction substantially perpendicular to said first direction.

10. The pallet locator system as in claim 9 wherein said means to move said locator means is operative to move said locator means in a third direction substantially perpendicular to said first and said second directions.

11. The pallet locator system as in claim 9 wherein said aperture portion comprises elongated slot portions formed in said support surface.

12. A non-intrusive workpiece pallet locator comprising:

a support surface;

means defining an aperture portion in said support surface;

locator means for engaging and locating a workpiece pallet;

means to move said locator means to extend and retract through said aperture portion in a first direction for engaging with and disengaging from the workpiece pallet; and wherein said aperture portion comprises elongated slot portions formed in said support surface, said slot portions including a first slot extending along said support surface and a plurality of second slots extending from said first slot substantially perpendicular to said first slot.

13. The pallet locator system as in claim 12 wherein said means to move said locator means is operative to move said locator means along said first and second slots.

14. An apparatus including a non-intrusive workpiece pallet locator, the apparatus comprising:

a support surface;

means defining an aperture portion in said support surface;

locator means for engaging and locating a workpiece pallet;

means to move said locator means to extend and retract through said aperture portion in a first direction for engaging with and disengaging from the workpiece pallet; and drive means for engaging and guiding the workpiece pallet in movement along said support surface, wherein said means for moving said locator means is operative to move said locator means to position the workpiece pallet into engagement with said drive means.

15. An apparatus including a non-intrusive workpiece pallet locator, the apparatus comprising:

a support surface;

means defining an aperture portion in said support surface;

locator means for engaging and locating a workpiece pallet;

means to move said locator means to extend and retract through said aperture portion in a first direction for engaging with and disengaging from the workpiece pallet; and holding means and means for automatically actuating said holding means to hold a workpiece on the workpiece pallet,

16. An apparatus including a non-intrusive workpiece pallet locator, the apparatus comprising:

a substantially planar support surface;

means defining a major elongated slot through said support surface;

means defining a plurality of minor elongated slots through said support surface extending substantially perpendicular from said major slot;

locator means positioned beneath said support surface, and means for moving said locator means such that said locator means is moveable in an X direction parallel to said support surface and in a Y direction perpendicular to said X direction, said locator means including pawl means actuated by said means for moving said locator means to move in a Z direction perpendicular to said X and Y directions for engaging apertures in the workpiece pallet;

drive means for engaging the workpiece pallet, said drive means including means adapted to move the workpiece pallet relative to said support surface;

holder means including means adapted to move toward and hold a workpiece on the workpiece pallet; and control means for actuating said locator means, said drive means and said holder means in a predetermined sequence of operations.

17. The apparatus as in claim 16 wherein said minor slots define three stations along said major slot with each station including two minor slots extending in said Y direction and spaced apart a distance D.

18. The apparatus as in claim 17 wherein said locator means includes first and second pawl sets, each pawl set including two pawls spaced apart said distance D and wherein each said pawl set may be simultaneously aligned with said minor slots of two of said stations.

19. A method of locating a workpiece pallet on a support surface comprising the steps of:

actuating a locator means to engage the workpiece pallet and subsequently actuating said locator means to move the workpiece pallet along the support surface from a loading station to a sewing station; and actuating said locator means to move the workpiece pallet along the support surface into engagement with a drive means for moving the workpiece along the support surface in a predetermined pattern within said sewing station.

20. The method as in claim 9 wherein the step of actuating said locator means to engage the workpiece pallet includes moving said locator means to a position beneath a workpiece located over a coupling point between the workpiece pallet and said locator means.

21. The method as in claim 19 wherein the step of actuating said locator means to engage the workpiece pallet includes causing a pawl means to pass through the support surface into contact with the workpiece pallet.

22. The method as in claim 19 wherein the step of actuating said locator means to move the workpiece pallet from said loading station to said sewing station includes moving the workpiece pallet in at least two directions perpendicular to each other.

23. The method as in claim 19 including the step of actuating holding means to move into engagement with a workpiece positioned on the workpiece pallet whereby the workpiece is held in position during movement of the workpiece pallet.

24. The method as in claim 23 wherein said locator means and said holding means are actuated by a control means.

25. The method as in claim 19 including the step of simultaneously engaging two workpiece pallets on the support surface.

26. The method as in claim 19 including the step of actuating said locator means to disengage from the workpiece pallet subsequent to said locator means positioning the workpiece pallet in engagement with said drive means.

27. The method as in claim 26 including the steps of moving workpiece pallet within said sewing station to sew a workpiece and then actuating said locator means to engage the workpiece pallet to move the workpiece pallet from the sewing station.

28. An apparatus including a workpiece pallet locator comprising:

a support surface for supporting a workpiece pallet;

a locator for operatively coupling to the workpiece pallet;

a first driver for moving said locator such that the workpiece pallet is moved about said support surface; and a second driver for engaging and guiding the workpiece pallet in movement along said support surface, wherein said first driver moves said locator to position the workpiece pallet into operative relationship with said second driver.

29. The apparatus as in claim 28 including a sewing head wherein said second driver guides the workpiece pallet in said movement under said sewing head.

* * * * *

UNITED STATES PATENT AND TRADEMARK OFFICE

CERTIFICATE OF CORRECTION

PATENT NO. : 5,363,785

DATED : Nov. 15, 1994

INVENTOR(S) : Ralph F. Conley, Jr.

It is certified that error appears in the above-indentified patent and that said Letters Patent is hereby corrected as shown below:

Col. 6, line 3, delete "a" and insert -- said --.

Col. 8, line 19, change "claim 9" to -- claim 19 --.

Signed and Sealed this

Sixteenth Day of January, 1996

Bruce Lehman

*Attest:*

BRUCE LEHMAN

*Attesting Officer*

*Commissioner of Patents and Trademarks*